US010654603B2

(12) United States Patent
Harth et al.

(10) Patent No.: US 10,654,603 B2
(45) Date of Patent: May 19, 2020

(54) INFLATING STATION FOR INFLATING OF FILM BAGS AND CORRESPONDING METHOD

(71) Applicant: INDAG Pouch Partners GmbH, Eppelheim (DE)

(72) Inventors: Rolf Harth, Neckargemund (DE); Frank Lechert, Weinheim (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 197 days.

(21) Appl. No.: 15/227,589

(22) Filed: Aug. 3, 2016

(65) Prior Publication Data

US 2017/0036793 A1 Feb. 9, 2017

(30) Foreign Application Priority Data

Aug. 7, 2015 (EP) ..... 15180147

(51) Int. Cl.
*B65B 43/18* (2006.01)
*B65B 43/30* (2006.01)
(Continued)

(52) U.S. Cl.
CPC ..... *B65B 43/18* (2013.01); *B65B 43/30* (2013.01); *B65B 43/36* (2013.01); *B65B 57/00* (2013.01); *B65B 59/02* (2013.01)

(58) Field of Classification Search
CPC ..... B65B 31/048; B65B 43/18; B65B 43/30; B65B 43/465; B65B 43/46; B65B 43/305; B65B 43/36; B31B 50/80; B29C 66/8221
See application file for complete search history.

(56) References Cited

U.S. PATENT DOCUMENTS 3,545,166 A 12/1970 Johnson et al.
3,577,704 A * 5/1971 Lense ..... B65B 43/30 53/386.1

(Continued)

FOREIGN PATENT DOCUMENTS

WO 9959876 A2 11/1999

OTHER PUBLICATIONS

European Search Report, EP Application No. 15180147, dated Dec. 4, 2015, pp. 1-8.

*Primary Examiner* — Andrew D Stclair
(74) *Attorney, Agent, or Firm* — Mayer Brown LLP

(57) ABSTRACT

The invention relates to an inflating station for inflating of film bags with a first and a second suction bar arm and with an inflating bar with inflating spouts arranged on it. The first/second suction bar arm is movable with a first/second drive shaft. A servo engine is disposed on the first drive shaft. A drive movement of the first drive shaft is transferred from a first gear wheel to a second gear wheel and from the second gear wheel to the second drive shaft. Further, the invention relates to a method for inflating of film bags with this inflating station with the steps: positioning of the film bags below the inflating station; closing of the suction bar arms and application of a first contact pressure; horizontal displacement of the vacuum cups in a first direction, establishment of the contact with the film bag halves, formation of a negative pressure; horizontal displacement of the vacuum cups in a second direction, therefore opening of the film bags; inserting of the inflating spouts in the film bags; increasing of the contact pressure to a second value and subsequent inflating of the film bags by means of the inserted inflating spouts.

5 Claims, 3 Drawing Sheets

(51) Int. Cl.

| | |
|---|---|
| ***B65B 43/36*** | (2006.01) |
| *B65B 57/00* | (2006.01) |
| *B65B 59/02* | (2006.01) |

(56) References Cited

U.S. PATENT DOCUMENTS

| | | | | |
|---|---|---|---|---|
| 3,592,004 | A * | 7/1971 | Lense | B65B 43/36 53/385.1 |
| 4,066,945 | A * | 1/1978 | Korte, Jr. | H02P 7/04 318/599 |
| 4,724,656 | A * | 2/1988 | Tanaka | B65B 3/24 141/128 |
| 5,115,619 | A * | 5/1992 | Lieder | B65B 1/34 141/313 |
| 5,722,221 | A | 3/1998 | Maltman | |
| 6,094,891 | A * | 8/2000 | Savigny | B65B 43/36 141/145 |
| 6,282,871 | B1 * | 9/2001 | Killinger | B65B 43/123 53/459 |
| 7,025,097 | B1 * | 4/2006 | Hayes | B65B 43/30 141/10 |
| 9,546,050 | B2 * | 1/2017 | Kronsteiner | B65G 49/061 |
| 2002/0050126 | A1 * | 5/2002 | Koppe | B65B 43/465 53/459 |
| 2003/0024409 | A1 | 2/2003 | Ruiz | |
| 2007/0074492 | A1 * | 4/2007 | Koga | B65B 43/36 53/512 |
| 2008/0098697 | A1 * | 5/2008 | Murray | B65B 43/30 53/457 |
| 2008/0110132 | A1 * | 5/2008 | Yan Ruz | B65B 43/18 53/459 |
| 2012/0111449 | A1 * | 5/2012 | Hsu | B65B 1/10 141/82 |
| 2016/0122055 | A1 * | 5/2016 | Fu | B65B 1/04 53/570 |

* cited by examiner

INFLATING STATION FOR INFLATING OF FILM BAGS AND CORRESPONDING METHOD

CROSS-REFERENCE TO RELATED APPLICATIONS

This application claims the benefit of priority to European Patent Application No. 15180147.9, filed Aug. 7, 2015, which is incorporated by reference herein in its entirety.

BACKGROUND

Inflating stations for film bags, which comprise a suction bar and an inflating bar, are known. To be able to insert the inflating spouts of the inflating bar into the film bags, the inflating bar is moved in relation to the suction bar by means of a rack with a knee switch and a pressurized air spring. The required contact pressure is also formed by means of the rack with the knee switch and pressurized air spring. The pressurized air spring limits the maximum applied force in the dead center of the knee switch.

Due to the high masses of rack, knee switch and pressurized air spring that have to be moved, there will be a limitation of the machine speed and the positioning accuracy. In addition, the contact pressure cannot be monitored and/or not controlled accurately, which leads to increased wear of the vacuum cups of the suction bar. Also, there can be very long setting times of the racks after maintenance works. In addition, no sufficient flexibility with regard to processing of different film types for example with different formats is ensured.

SUMMARY

The present invention provides, in various embodiments, an inflating station for inflating film bags and a corresponding method, which enable an increased throughput and a more wear-free operation of the inflating station.

In some embodiments, the invention provides an inflating station in a film bag filling apparatus for inflating film bags prior to a filling process. In some embodiments, the inflating station comprises a first suction bar arm and a second suction bar arm for opening of two or more film bags that are arranged next to one another; and an inflating bar with inflating spouts arranged on said inflating bar for inflating the opened film bags, wherein the first suction bar arm is moveable with a first drive shaft and the second suction bar arm is moveable with a second drive shaft. In some embodiments, a servo engine is arranged on the first drive shaft and a drive movement of the first drive shaft is transferred from a first gear wheel to a second gear wheel that encroaches in the first gear wheel, and from the second gear wheel to the second drive shaft.

In some embodiments, the suction bar arms comprise vacuum cups configured to open the film bags by means of vacuum suction.

In some embodiments, the suction bar arms comprise clamping bars with bulgings, and wherein the clamping bars comprise elastic material.

In some embodiments, the inflating bar is vertically displaceable.

In some embodiments, the suction bar arms are configured to apply a contact pressure in a closed state.

In some embodiments, the inflating station further comprises a measurement and control device for a current of the servo engine.

In some embodiments, the measurement and control device is configured to control the contact pressure based on type information of the film bags by means of the current of the servo engine.

In some embodiments, the inflating station further comprises an evaluation and control device configured to calculate a strength of a pressure momentum for inflating based on type information of the film bags.

In some embodiments, the inflating station further comprises a film bag transporting device.

In some embodiments, the invention provides a method for inflating film bags using the above-described inflating station, the method comprising positioning the film bags below the inflating station; closing the suction bar arms and applying a contact pressure having a first value; horizontally displacing the vacuum cups in a first direction, bringing the vacuum cups in contact with corresponding film bag halves, and forming a negative pressure, horizontally displacing the vacuum cups in a second direction and opening the film bags; inserting the inflating spouts in the opened film bags; increasing the contact pressure to a second value; and inflating of the film bags by means of the inserted inflating spouts.

In some embodiments, the method further comprises, after the inflating step, opening the suction bar arms; and removing the inflating spouts from the inflated film bags.

In some embodiments, the method further comprises removing the inflated film bags.

In some embodiments, the method further comprises at least one of entering type information of the film bags into a data memory and reading type information of the film bags out of a data memory; calculating a set current of the servo engine based on the type information using a measurement and control device; and controlling the servo engine responsive to the calculated set current.

DETAILED DESCRIPTION

Figure 1:
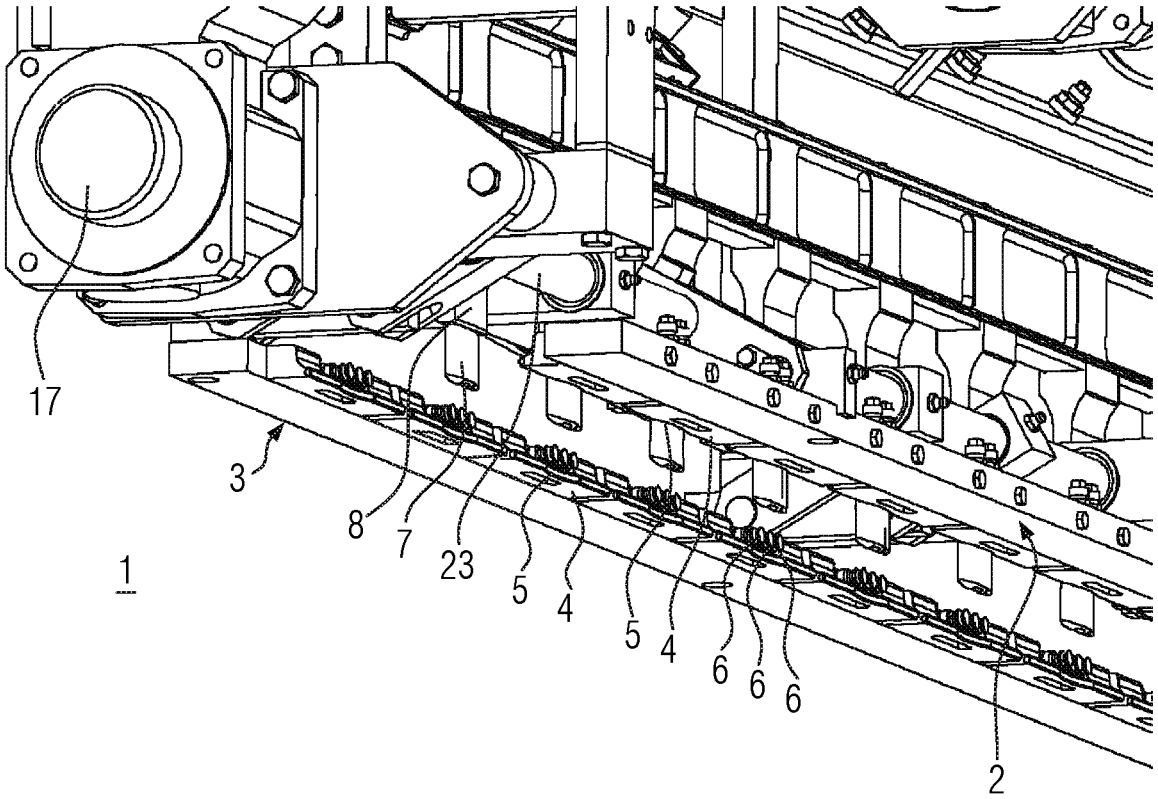
FIG. 1 shows a perspective view of an open inflating station in a first viewing direction from the bottom at an angle.

The inflating station of a film bag filling apparatus for inflating of film bags prior to a filling process comprises a first suction bar arm and a second suction bar arm for opening of multiple film bags that are disposed next to one another and an inflating bar with inflating spouts arranged on it for inflating of the opened film bags, wherein the first suction bar arm is movable with a first drive shaft and the second suction bar arm with a second drive shaft. A servo engine is arranged on the first drive shaft and a drive movement of the first drive shaft is transferred by a first gear wheel to a second gear wheel that encroaches in the first gear wheel and from the second gear wheel to the second drive shaft. The two suction bar arms can in addition be designed in a closed state to hold the film bags to be inflated for and/or during the inflating process.

The film bag filling apparatus can be provided in the food-processing industry for filling of liquid or chunky foodstuff such as beverages or mash into film bags.

However, it is also possible instead and/or similarly that the film bag filling apparatus is provided in the animal feed processing industry for filling of liquid or chunky feedstuff such as cat milk or moist food into film bags.

Film bags that are to be filled are stored in a folded state prior to filling. To be able to perform a filling process, the film bags are formed prior to filling, which means that a hollow space, into which the filling product is to be filled, is created on the inside of them.

By using a servo engine that is arranged directly on a drive shaft, the racks, the pressurized air spring and the knee switch that are required in the state of the art can be omitted. Hence, the inflating station according to the invention has a lower mass compared to an inflating station of the state of the art so that a higher operating speed is possible. In addition, long setting times after a maintenance step of the inflating station are no longer necessary.

Due to the arrangement of the servo engine on the first drive shaft, a direct impact of the servo engine on this drive shaft is possible, which ensures accuracy in positioning of the suction bar arms and the contact pressure that arises between them so that the signs of wear of the suction bar arms, in particular of the vacuum cups, are minimized as for example the contact pressure of the two suction bar arms, i.e. also of the clamping bars, can be adjusted. In addition, a defined inflating process of the film bags is possible due to the exact positioning as also the inflating spouts can be positioned accurately in the opened film bags and the bulgings of the clamping bars.

Through the gear wheel drive with the two meshing gear wheels, the drive movement of the first drive shaft is transferred to the first gear wheel and from there to the second gear wheel and hence to the second drive shaft. As the first drive shaft is responsible for a drive movement of the first suction bar arm and the second drive shaft for a drive movement of the second suction bar arm, there is always a synchronous movement of the two suction bar arms during opening and/or closing of the inflating station. Due to this arrangement of the suction bar arms and of the described drive, it is therefore possible to perform a rotary parallel movement wherein the desired precise performance of the movement and a control of the contact pressure of the two suction bar arms can be ensured.

The suction bar arms can comprise vacuum cups that are designed to open film bags by means of vacuum suction. As the film bags are transferred to the inflating station in a folded state, it is required for an inflating process of the film bags to be performed to open the film bags at first so that the inflating spouts can be inserted in the opened film bags. In the upper area of the film bags, the vacuum cups are arranged on the suction bar arms. The vacuum cups are each brought in contact with the corresponding film bag halves through horizontal displacement in a first direction. The first direction is oriented towards the film bags in this case. Through sucking off air in the vacuum cups, a negative pressure and hence a suction effect is created so that the two film bag halves are aspirated in the area of the vacuum cups. By means of a horizontal displacement of the vacuum cups in a second direction opposite to the first direction, the film bag halves are pulled apart wherein the film bags are opened so that the inflating spouts can be positioned in them.

In addition, suction bar arms can comprise clamping bars with bulgings, wherein the clamping bars preferably comprise elastic material. The bulgings are provided so that inflating spouts can be inserted through the closed clamping bars in the film bag that is held by the clamping bars and already opened. The elastic material enables an even distribution of the contact pressure that is applied by the closed suction bar arms.

The inflating bar with the inflating spouts arranged on it can be vertically displaceable so that the inflating spouts can be inserted in the opened film bags for an inflating process and/or taken back out of the film bags after the inflating process.

The suction bar arms can be designed to apply a contact pressure in a closed state. The strength of the contact pressure can be modifiable so that air-tight sealing is also possible during interaction with the inserted inflating spouts besides the support of film bags.

The inflating station can further comprise a measurement and control unit for a current of the servo engine. The measurement and control unit enables measurement of the current that flows into the servo engine and/or a control of the current so that it is possible to modify, i.e. to control, the current during an inflating process, prior to or after said inflating process.

The measurement and control device can be designed to control the contact pressure based on type information of the film bags such as film bag formats, filling volumes and/or film bag materials by means of the current of the servo engine. Therefore, such a current can be calculated on the basis of the type information. The calculated set current corresponds to a desired contact pressure that is to be applied by the suction bar arms. The type information of the film bags can be entered in the measurement and control device and/or be read out of a data memory. The data memory can be a part of the measurement and control unit or the data memory can be a memory that is independent of said measurement and control unit.

It can be advantageous to increase the contact pressure if film bags are to be inflated whose film bag material has for example a greater thickness than previously inflated film bags or if their size, i.e. the format, is larger than previously inflated film bags. Accordingly, it can be advantageous to decrease the contact pressure if film bags are to be inflated whose film bag material has for example a smaller thickness than previously inflated film bags or if their size, i.e. the format, is smaller than previously inflated film bags.

Further, the inflating station can comprise an evaluation and control unit that is designed to calculate a strength of a pressure momentum for inflating based on type information of the film bags such as filling volume, film bag format and/or film material. To ensure a defined inflating process of the film bags so that the hollow space that is created on the inside of the film bags is the same for each film bag of an identical type, it will be advantageous if the inflating process takes place by means of a pressure momentum with a defined strength, i.e. a set strength. The set strength is preferably adapted to the type information of the film bags. The pressure momentum can be created by the inflating spouts of the inflating bar for inflating of the film bags and/or led into the film bags. Accordingly, the evaluation and control unit would control the inflating spouts as they use the pressure momentum with the calculated set strength for inflating of the film bags.

The measurement and control device and the evaluation and control device can each be a separate device and/or unit, but it can also be provided that they form a joint device and/or unit.

The inflating station can further comprise a film bag transport device. With the film bag transport device, the folded film bags can be inserted in the inflating station for an inflating process and/or after finishing the inflating process, the inflated film bags can be led into further processes by means of the film bag transport device.

A method according to the invention for inflating of film bags with the inflating station as described above or further below comprises the steps: positioning of the film bags below the inflating station; closing of the suction bar arms and application of a contact pressure with a first value; horizontal displacement of the vacuum cups in a first direction and establishment of a contact with the respective film bag halves, formation of a negative pressure, horizontal displacement of the vacuum cups in a second direction and therefore opening of the film bags; inserting the inflating spouts in the opened film bags; increase of the contact pressure to a second value and subsequent inflating of the film bags by means of the inserted inflating spouts.

After the inflating step, opening of the suction bar arms and removal of the inflating spouts from the inflated film bags can take place.

Afterwards, removal of the inflated film bags can take place in order to use such inflated film bags for further processes.

The method can comprise the further steps: entry of type information of the film bags and/or reading of type information of the film bags out of a data memory; calculation of a set current of the servo engine based on the type information by means of a measurement and control unit and control of the servo engine according to the calculated set current.

Figure 2:
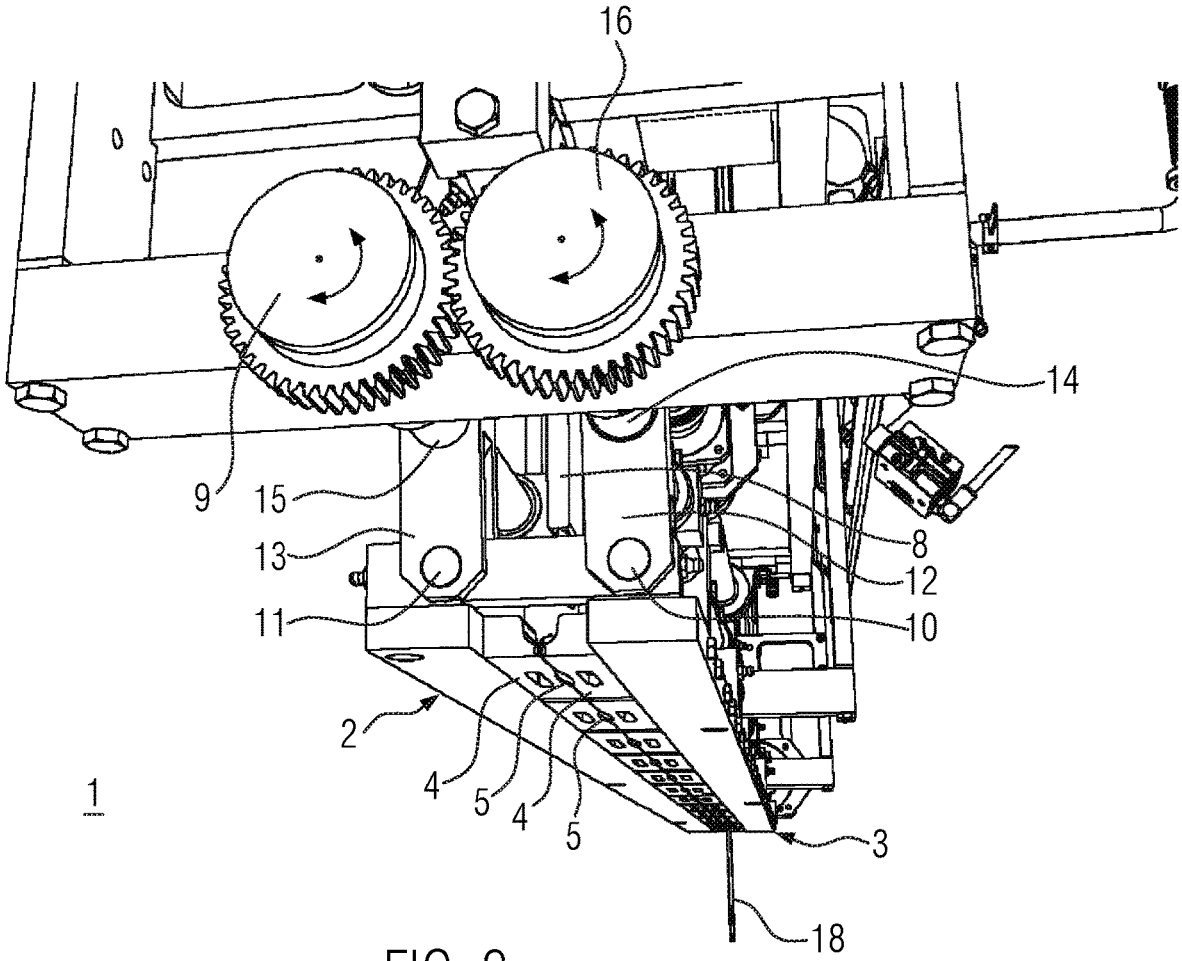
FIG. 2 shows a perspective view of the open inflating station in a second viewing direction from the bottom at an angle.
Figure 3:
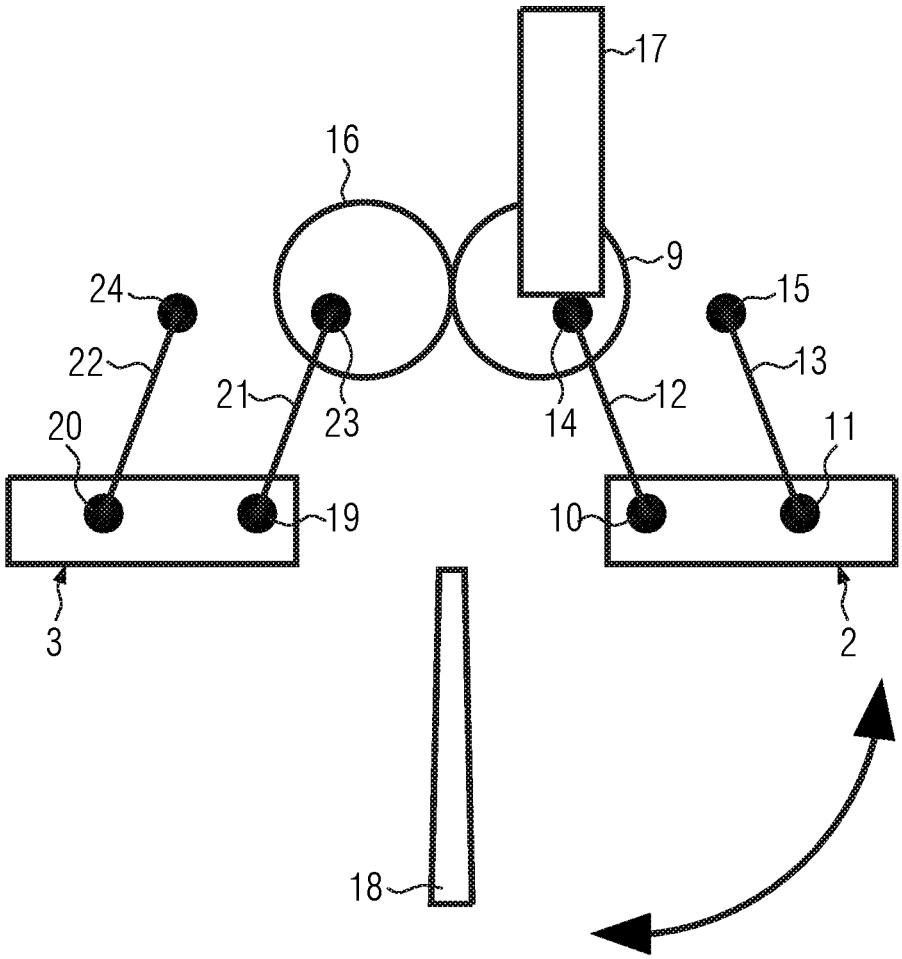
FIG. 3 shows a detail regarding the movement of the two suction bar arms.

The enclosed Figures display aspects of the invention in an exemplary way for better understanding and illustration. The Figures show:

FIG. 1 a perspective view of an open inflating station in a first viewing direction from the bottom at an angle, FIG. 2 a perspective view of the open inflating station in a second viewing direction from the bottom at an angle and FIG. 3 a detail regarding the movement of the two suction bar arms.

FIG. 1 shows a perspective view of an open inflating station 1 in a first viewing direction at an angle from the bottom of the inflating station 1, so that the side of the inflating station 1 with the servo engine 17 can be seen. The inflating station 1 comprises two suction bar arms 2, 3 that can be moved in relation to one another. The suction bar arms 2, 3 are mirror-symmetric and have, in the area in which they can be brought in contact or in which the film bags can be held, respectively multiple elements that are arranged next to one another along the suction bar arms 2, 3 that are used for clamping and opening of film bags in case of a closed inflating station 1. These elements comprise each a clamping bar 4 with a bulging 5 in the middle and multiple vacuum cups 6 per element. The bulging 5 is provided so that inflating spouts 7 can be inserted through the closed clamping bars 4 in the film bags that are held by the clamping bars 4 and already opened. The inflating spouts 7 can be moved through vertical displacement of the inflating bar 8 on which they are installed. The film bags are led into the inflating station in a folded state by means of a film bag transport device (not shown) in which the film bags are aligned in relation to the inflating station 1 in such a way that the film bags can be held and/or clamped in an upper area between the clamping bars 4 when the suction bar arms 2, 3 are closed. The clamping bars 4 comprise preferably an elastic material.

The dimensions of the inflating spouts 7 are provided in a way that they can be inserted in the open film bags through the bulging 5 of the clamping bars 4 and thereby also ensure an essentially air-tight seal through interaction with the contact pressure of the suction bar arms 2, 3 after inserting so that the film bags can be inflated in a defined way by means of air that is led in through the inflating spouts 7.

Opening and/or closing of the suction bar arms 2, 3 occurs by means of the servo engine 17 that is arranged directly on a first drive shaft 14 (not visible here; see FIG. 2). Due to this arrangement, a direct impact of the servo engine 17 on the first drive shaft 14 is possible wherein the movement of the two suction bar arms 2, 3 can be controlled better and wherein accuracy in positioning of the suction bar arms 2, 3 is ensured. Due to this, signs of wear of the suction bar arms 2,3, in particular of the vacuum cups 6, can be minimized as for example the contact pressure of the two suction bar arms 2, 3, i.e. also the clamping bars 4, is adjustable. In addition, defined inflating of the film bags 18 is also possible due to the exact positioning because also the inflating spouts 7 can be positioned accurately in the opened film bags 18 and the bulgings 5 of the clamping bars 4.

The first suction bar arm 2 can be moved by means of the first drive shaft 14 on one of whose ends the servo engine 17 and on whose other end a first gear wheel 9 (not visible here; see FIG. 2) is arranged. The first suction bar arm 2 has two axes 10, 11 (not visible here; see FIG. 2), wherein the first axis 10 is connected to the first drive shaft 14 by means of a first rack 12 and the second axis 11 is connected by means of a second rack 13 to a third axis 15 that is parallel to the first drive shaft 14.

The second suction bar arm 3 also has two axes 19, 20 (not visible here; see FIG. 3), wherein the first axis 19 is connected by means of a first rack 21 to the second drive shaft 23 and hence to a second gear wheel (not visible here; see FIG. 2) and the second axis 20 is connected by means of a second rack 22 to a third axis 24 that is parallel to the second drive shaft 23 (not displayed here; see FIG. 3).

FIG. 2 shows a perspective view of the closed inflating station 1 in a second viewing direction at an angle from below the inflating station 1 so that the side of the inflating station 1 with the two gear wheels 9, 16 can be seen. The two suction bar arms 2, 3 were moved towards one another and the inflating station 1 was closed so that the clamping bars 4 are now in contact and/or clamped between the clamping bars 4 of the upper areas of the film bags 18 to be inflated or held by said clamping bars. There is a contact pressure between the two suction bar arms 2, 3 whose strength can be controlled by the servo engine 17. The passages for the inflating spouts 7 that are formed through the bulgings 5 in the clamping rails 4 are shown clearly.

The closing movement of the two suction bar arms 2, 3 was performed by the gear wheel drive with the meshing first 9 and second gear wheels 16 wherein the movement of the first gear wheel 9 was transferred to the second gear wheel 16. Hence, a synchronous movement of the first 2 and the second 3 suction bar arm took place during closing that was originated by the servo engine 17 arranged on the first drive axis 14.

As the film bags 18 are transferred to the inflating station 1 in a folded state, it is required for an inflating process of the film bags 18 to be performed by means of the inflating spouts 7 to open the film bags 18 at first so that the inflating spouts 7 can be inserted in the opened film bags 18.

An exemplary display shows a film bag 18 that is held between two clamping bars 4 of the suction bar arms 2, 3. In the upper, not visible area of the film bag 18, the vacuum cups 6 are arranged on the suction bar arms 2, 3. They are each brought in contact with the respective film bag halves by means of horizontal displacement in a first direction. The first direction in this process is oriented towards the film bag 18. Through suction of air in the vacuum cups 6, a negative pressure and hence a suction effect are created so that the two film bag halves are aspirated in the area of the vacuum cups 6 and that they can be pulled apart through a horizontal displacement of the vacuum cups 6 in a second direction that is opposite to the first direction, wherein the film bags 18 are opened so that the inflating spouts 7 can be inserted in them for the inflating process.

During inserting or after having inserted the inflation spouts 7 in the film bags 18, the contact pressure of the two suction bar arms 2, 3 can be readjusted by means of the servo engine 17, for example through monitoring and adjustment of the power intake of the servo engine 17. Through an increase of the contact pressure, the film bags 18 cannot only be held between the clamping bars 4 of the suction bar arms 2, 3, but sealed after having inserted the inflating spouts 7 in the film bags 18. Without such a seal, a part of sterile gas and/or sterile air, which is led into the film bags 18 by means of the inflating spouts 7 during the inflating process, would be able to escape again. Through such an inflating step, in which gas and/or air escapes again during inflating, film bags 18 would not have a defined form and hence no defined hollow space inside them after the inflating process.

Through readjustment of the contact pressure of the two suction bar arms 2, 3 by means of the servo engine 17, which is installed directly on the drive shaft 14, after the vacuum cups 6 have already moved in the second direction, an additional mechanical stress of the vacuum cups 6 is avoided so that signs of wear can be minimized.

After an inflating and opening step of the suction bar arms 2, 3, the inflated film bags 18 can be led into further processes by means of the film bag transport device.

FIG. 3 shows a detail of the movement of the two suction bar arms 2, 3. In this schematic side view, the first 2 and the second suction bar arm 3 as well as the first 9 and the second gear wheel 16 are displayed. The first suction bar arm 2 can be moved by the first drive shaft 14 on one of whose ends the servo engine 17 and on whose other end the first gear wheel 9 is installed. The first suction bar arm 2 in addition has axes 10, 11, wherein the first axis 10 is connected by means of a rack 12 to the first drive shaft 14 and the second axis 11 by means of a rack 13 to a third axis 15 that is parallel to the first drive shaft 14.

The second suction bar arm 3 also has two axes 19, 20, wherein the first axis 19 is connected by means of a rack 21 to the second drive shaft 23 and the second axis 20 by means of a rack 22 to a third axis 24 that is parallel to the second drive shaft 23.

Through this gear wheel drive with two meshing gear wheels 9, 16, the movement of the first gear wheel 9 is transferred to the second gear wheel 16 and hence a drive movement of the first drive shaft 14, on which the servo engine 17 is installed, is transferred to the second drive shaft 23. Consequently, there is always a synchronous movement of the first 2 and the second 3 suction bar arm during opening and/or closing of the inflating station 1. Due to the displayed arrangement of the two suction bar arms 2, 3 it is therefore possible to perform a rotary parallel movement due to which the desired precise performance of the movement and a control of the contact pressure of the two suction bar arms 2, 3 can be ensured.

The invention claimed is:

1. An inflating station in a film bag filling apparatus for inflating film bags prior to a filling process, wherein the inflating station comprises:

a first suction bar arm and a second suction bar arm configured to open two or more film bags that are arranged next to one another;

a first drive shaft for moving the first suction bar arm and a second drive shaft for moving the second suction bar arm;

a first gear wheel arranged on the first drive shaft and a second gear wheel arranged on the second drive shaft, the first gear wheel meshing with the second gear wheel;

an inflating bar with inflating spouts arranged thereon for inflating the opened film bags; and a servo engine arranged on the first drive shaft, wherein a drive movement of the first drive shaft transfers from the first gear wheel to the second gear wheel, and from the second gear wheel to the second drive shaft, thereby providing synchronous movement of the suction arms, wherein the suction bar arms comprise vacuum cups configured to, in a closed state of the suction bar arms, open film bags by vacuum suction and horizontal movement of the vacuum cups, and wherein the suction bar arms comprise clamping bars with bulgings, wherein the suction bar arms are configured to apply a contact pressure in the closed state of the suction bar arms, wherein inflating spouts for inflating the opened film bags are arranged at the inflating bar, wherein the inflating bar is vertically displaceable.

2. The inflating station of claim 1, wherein the clamping bars comprise elastic material.

3. The inflating station of claim 1, wherein a current flowing into a servo engine determines the contact pressure.

4. The inflating station of claim 3, wherein current is set based on type information of the film bags.

5. The inflating station of claim 1, wherein the inflating spouts are configured to provide a pressure momentum for inflating with a strength based on type information of the film bags.

* * * * *